US010458387B2

(12) United States Patent
Kopecki

(10) Patent No.: US 10,458,387 B2
(45) Date of Patent: Oct. 29, 2019

(54) HYDROSTATIC AXIAL PISTON MACHINE

(71) Applicant: Robert Bosch GmbH, Stuttgart (DE)

(72) Inventor: Josef Kopecki, Herrenberg (DE)

(73) Assignee: Robert Bosch GmbH, Stuttgart (DE)

( * ) Notice: Subject to any disclaimer, the term of this patent is extended or adjusted under 35 U.S.C. 154(b) by 190 days.

(21) Appl. No.: 15/364,538

(22) Filed: Nov. 30, 2016

(65) Prior Publication Data

US 2017/0159640 A1 Jun. 8, 2017

(30) Foreign Application Priority Data

Dec. 3, 2015 (DE) ..... 10 2015 224 129

(51) Int. Cl.

| | |
|---|---|
| ***F03C 1/06*** | (2006.01) |
| ***F03C 1/34*** | (2006.01) |
| ***F04B 1/12*** | (2006.01) |
| ***F04B 1/20*** | (2006.01) |
| ***F04B 1/22*** | (2006.01) |
| ***F04B 1/30*** | (2006.01) |
| ***F03C 1/32*** | (2006.01) |
| ***F03C 1/40*** | (2006.01) |

(52) U.S. Cl.

CPC ..... *F03C 1/0668* (2013.01); *F03C 1/0652* (2013.01); *F03C 1/0655* (2013.01); *F03C 1/0692* (2013.01); *F04B 1/122* (2013.01); *F04B 1/124* (2013.01); *F04B 1/2035* (2013.01); *F04B 1/2042* (2013.01); *F04B 1/2078* (2013.01); *F04B 1/22* (2013.01); *F04B 1/303* (2013.01)

(58) Field of Classification Search

CPC .... F03C 1/0668; F03C 1/0692; F03C 1/0652; F03C 1/0655; F03C 1/06557; F04B 1/30; F04B 1/22; F04B 1/2035; F04B 1/2078; F04B 1/124; F04B 1/122; F04B 1/2042

See application file for complete search history.

(56) References Cited

U.S. PATENT DOCUMENTS 3,604,314 A * 9/1971 Steiner ..... F01B 3/0047 91/485
5,807,080 A * 9/1998 Ochiai ..... F04B 1/2021 417/269

FOREIGN PATENT DOCUMENTS

DE 10 2010 006 895 A1 8/2011
DE 102010006895 A1 * 8/2011 ..... F03C 1/0647
DE 102010006895 A1 * 8/2011 ..... F04B 1/30

OTHER PUBLICATIONS

DE102010006895 Translation, Aug. 2011, Kopecki; Josef, F04B1/30.*
DE102010006895 Translation, Aug. 2011, Kopecki; Josef, F04B1/30 (Year: 2011).*

* cited by examiner

*Primary Examiner* — Devon C Kramer
*Assistant Examiner* — David N Brandt
(74) *Attorney, Agent, or Firm* — Maginot, Moore & Beck LLP

(57) ABSTRACT

A hydrostatic axial piston pump of swashplate construction, which is also configured to be operated as a motor, has a stationary control plate against which a rotating cylinder drum is tensioned. During operation, a tilting tendency of the cylinder drum arises in the direction of that quadrant of the control plate which is operatively connected to the first part of the displacement stroke of the pistons. The control plate has a supporting device configured for the cylinder drum. The supporting device is arranged adjacent to an outer edge of the control plate in the first quadrant thereof. The supporting device is configured to be formed by a hydrostatically relieved additional field.

12 Claims, 6 Drawing Sheets

HYDROSTATIC AXIAL PISTON MACHINE

This application claims priority under 35 U.S.C. § 119 to patent application no. DE 10 2015 224 129.7, filed on Dec. 3, 2015 in Germany, the disclosure of which is incorporated herein by reference in its entirety.

BACKGROUND

The disclosure relates to an axial piston machine.

Axial piston machines have a cylinder drum, on the circumference of which a plurality of cylinder bores are provided in a uniformly distributed manner, said cylinder bores being introduced in the axial direction and being intended for the respective pistons, and a drive shaft which is connected to the cylinder drum for rotation therewith. Axial piston machines of oblique-axis construction and of swashplate construction are known. In the case of the last-mentioned construction, the cylinder drum is arranged concentrically with respect to the drive shaft, and both rotate about a common longitudinal axis. In each cylinder bore, a piston is accommodated in a displaceable manner and is connected at its respective end portion remote from the cylinder drum in an articulated manner to a sliding block which, during the operation of the axial piston machine, revolves about the longitudinal axis and, in the process, slides along a swashplate.

In order to produce the stroke of the pistons, the swashplate is positioned obliquely with respect to the longitudinal axis. In the case of an adjustable axial piston machine of swashplate construction, the swashplate is pivotable, as a result of which the stroke of the pistons in the cylinder bores is adjusted. Therefore, during the pump mode, the delivery volume flow of the pressure medium can be adjusted, or, during the motor mode, the rotational speed of the drive shaft serving as the output shaft can be adjusted.

The cylinder bores of the cylinder drum have to be connected once to the high-pressure side and once to the low-pressure side of the axial piston machine during a revolution. For this purpose, the rotating end surface of the cylinder drum that is spaced apart from the swashplate and in which the orifices of the cylinder bores are arranged is tensioned in the axial direction against a stationary distributor plate, which is also referred to as a control plate or distributor disk or control disk. Said distributor plate has a circular-arc-shaped high-pressure kidney-shaped aperture and a circular-arc-shaped low-pressure kidney-shaped aperture. Axial piston machines in which the two kidney-shaped apertures can be operated as a high-pressure kidney-shaped aperture and as a low-pressure kidney-shaped aperture according to choice are also known.

In order to minimize wear and friction, a hydrostatic relief is known which is arranged between the cylinder drum and the distributor plate in or on the contact surfaces thereof.

In the case of an axial piston machine in the pump mode, operationally induced contact pressure forces are higher than in the case of an axial piston machine in the motor mode.

Document DE 10 2010 006 895 A1 presents an axial piston machine with a hydrostatic main relief field and with a hydrostatic additional relief field on the distributor plate, which additional relief field can be switched on or off depending on the type of operation. Furthermore, a second virtually "mirrored" additional relief field is proposed on the other side of the distributor plate if the axial piston machine concerned also permits a pressure side change of the two kidney-shaped apertures.

A disadvantage of axial piston machines of this type is that, by means of various forces and moments which arise at the cylinder drum during the operation of the axial piston machine, the cylinder drum may lift off on one side and therefore easily tilt in the direction of or over a tilting point. This tilting point lies on the distributor plate in the high-pressure-side quadrant of the distributor plate, which quadrant is defined by the first part of the stroke movement of the pistons of the axial piston machine in the pump mode. This results in undesirable leakage which reduces the volumetric efficiency of the axial piston machine.

Furthermore, it is known from the prior art to distribute a plurality of segments uniformly at the edge of the cylinder drum, said segments being designed (not as hydrostatic relief fields) to counteract tilting of the cylinder drum and result in an increase in the diameter of the cylinder drum, as a result of which the tilting point is displaced radially outward. The risk of tilting over the tilting point of the first quadrant of the distributor plate is significantly reduced as a result.

A disadvantage of axial piston machines of this type is that the multiplicity of segments is expensive to manufacture and, because of their structural design, the segments increase the wear and the friction loss between the cylinder drum and the distributor plate.

SUMMARY

By contrast, the disclosure is based on the object of providing an axial piston machine in which tilting in the direction of or over a tilting point which lies asymmetrically in a first quadrant of the distributor plate is avoided, wherein the friction loss and the wear are reduced.

This object is achieved by an axial piston machine having the features of the disclosure.

Further advantageous refinements of the disclosure are described in the dependent patent claims.

The hydrostatic axial piston machine of swashplate construction has a cylinder drum which is tensioned against a distributor plate or control plate which has a high-pressure kidney-shaped aperture and a low-pressure kidney-shaped aperture. During the operation of the axial piston machine, the cylinder drum rotates in relation to the stationary distributor plate. The high-pressure kidney-shaped aperture defines a quarter-circle-shaped first quadrant and a quarter-circle-shaped second quadrant of the distributor plate, wherein a hydrostatic main relief field which extends into both quadrants is provided on the distributor plate directly adjacent to the high-pressure kidney-shaped aperture. The distributor plate has, on the outer circumference of the main relief field, a relief surface which serves as a supporting device and counteracts a tilting of the cylinder drum in the direction of the relief surface. According to the disclosure, a center point of the relief surface is arranged in the first quadrant of the distributor plate. An asymmetry of the relief is therefore provided which has been spatially reduced and concentrated at the crucial location in such a manner that the friction loss and the wear has been reduced in comparison to the segments which are distributed uniformly on the circumference of the cylinder drum.

In the case of operation of the axial piston machine according to the disclosure as an axial piston pump, that part of the high-pressure kidney-shaped aperture which is arranged in the first quadrant is operatively connected to an earlier part of a working stroke of a piston, whereas that part of the high-pressure kidney-shaped aperture which is arranged in the second quadrant is operatively connected to a later part of the same working stroke of the piston.

In particular, the relief surface arranged according to the disclosure causes a solid-state supporting force to act on the tilting point, said solid-state supporting force lying within the angular range of the sum total of the tilting moments acting on the cylinder drum.

A center axis of the distributor plate extends approximately centrally between the two kidney-shaped apertures, and therefore the two kidney-shaped apertures lie on different sides of the center axis. A center point of the distributor plate lies on the center axis. A supporting direction which is positioned at an angle of between 10 degrees and 50 degrees with respect to the center axis is defined by the center point of the distributor plate and the center point of the relief surface. It has been revealed by calculations that this angle is approximately 15 degrees. It has been revealed by tests in practice that this angle is approximately 45 degrees.

In its radial elevation, the main relief field defines a contact plane of the distributor plate, against which contact plane the cylinder drum lies. It is particularly preferred if the relief surface lies in the contact plane. The cylinder drum can then have a continuous flat end surface which is simple to manufacture and which lies, for example with a circular-ring-shaped portion, against the main relief field.

According to an exemplary embodiment which is simple in terms of manufacturing, the relief surface is closed and is without an inner recess.

The relief surface can be radially spaced apart from the main relief field. This permits a large radial distance of the relief surface according to the disclosure and optimizes the support.

In terms of device, it is simple if the relief surface is not hydrostatic, but rather is purely mechanical. For example, the latter can be realized by non-cutting shaping of the distributor plate exclusively in the region of interest for the stability of the cylinder. This creates an advantage in terms of costs in comparison to the segments manufactured over the entire circumference of the cylinder in the prior art.

Friction loss and the wear are minimized if the relief surface is formed by one or more hydrostatic additional relief fields.

An overall relief pressure force of the hydrostatic main relief field and of the at least one hydrostatic additional relief field together with a contact pressure force of the cylinder drum against the distributor plate can produce a moment here which acts counter to the tilting moment.

In a development, precisely one additional relief field is provided which forms a joint relief field with the main relief field, wherein the additional relief field merges directly into the main relief field and is arranged in the contact plane of the distributor plate.

The joint relief field in the second quadrant can have a smaller width here in the radial direction than in the first quadrant.

At least one portion of an outer edge of the joint relief field, which portion is arranged in the first quadrant, can is formed here by a continuous reduction in radius as viewed in the direction of the second quadrant.

The portion of the outer edge of the joint relief field with the continuous reduction in radius can extend here from the first quadrant into the second quadrant. In comparison to the prior art, area portions of the joint relief field can therefore be laid from the second into the first quadrant without the overall relief force of the joint relief field being increased.

In a preferred development, the at least one additional relief field has a pocket or recess in relation to the contact plane. Said pocket or recess can be bounded by a sealing edge which is arranged in the contact plane. The pressure profile, which basically decreases from the inside outwards, can be avoided in the region of the pocket or recess.

In a particularly preferred development, the pocket or recess is connected via an orifice to a hydraulic device via which pocket or recess can be acted upon with relief pressure medium, and/or via which the additional relief pressure is adjustable or controllable.

The device preferably has a switching valve via which the orifice and therefore the pocket or recess is connectable to the interior of a housing or to low pressure.

In a development, the orifice is connected to a location of the device that lies between a throttle and an adjustable throttle. Throttle and adjustable throttle together form a pressure divider circuit.

The additional relief field can be divided up into a plurality of approximately equally sized additional relief fields which are distributed on the outer circumference of the main relief field and in both quadrants. In order to achieve the effect according to the disclosure that the additional relief force and therefore the overall relief force lies in the first quadrant, the distances of the additional relief fields from one another are smaller in the first quadrant than in the second quadrant. For example, the distances between the additional relief fields increase continuously from the first to the second quadrant.

BRIEF DESCRIPTION OF THE DRAWINGS

An exemplary embodiment of an axial piston machine according to the disclosure and a plurality of exemplary embodiments of a distributor plate according to the disclosure of an axial piston machine of this type are illustrated in the drawings. The disclosure will now be explained in more detail with reference to the figures of said drawings.

In the drawings

DETAILED DESCRIPTION

Figure 1:
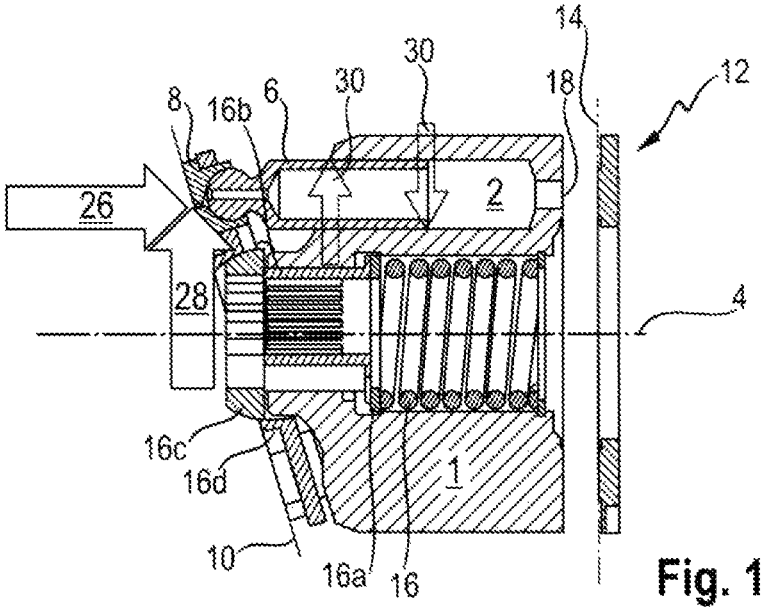
FIG. 1 shows, in a longitudinal section, essential parts of an axial piston machine according to the disclosure.

FIG. 1 shows essential parts of an axial piston pump, which is adjustable in its swept volume, of swashplate construction. A housing and a drive shaft are not illustrated. The axial piston pump has a cylinder drum 1, on the circumference of which a plurality of cylinder bores 2 are uniformly distributed, of which only one cylinder bore 2 is illustrated in FIG. 1. The cylinder drum 1 is connected to the drive shaft (not shown) for rotation therewith, and therefore said two parts revolve about a longitudinal axis 4 during the operation of the axial piston pump.

A piston 6 is accommodated and guided displaceably in each cylinder bore 2, said piston, at its respective end portion which is remote from the cylinder drum 1, being connected in an articulated manner to a sliding block 8 which revolves around the longitudinal axis 4 during the operation of the axial piston pump and, in the process, slides along a stationary swashplate 10.

In order to produce the stroke of the pistons 6, the swashplate 10 is positioned obliquely with respect to the longitudinal axis 4. The swashplate 10 is pivotable here, as a result of which the stroke of the pistons 6 and therefore a delivery volume flow of the pressure medium are adjusted. The pivoting angle of the swashplate 10 is adjusted via an adjustment device (not shown) which acts on the swashplate 10 on one side.

On the end side spaced apart from the swashplate 10, the cylinder drum 1 is tensioned against a substantially circular-disk-shaped distributor plate 12 which has a circular-ring-shaped axial projection in the direction of the cylinder drum 1, which projection defines a contact plane 14 for the cylinder drum 1. For reasons of clarity, the cylinder drum 1 is illustrated in FIG. 1 in a manner spaced apart from the distributor plate 12 and the contact plane 14 thereof.

A spring 16 surrounds the drive shaft (not shown) concentrically and is supported on the swashplate 10 via a supporting disk 16*a*, pressure pins 16*b*, a retraction ball 16*c*, a retraction plate 16*d* and the sliding blocks 8 and, in the process, pretensions the cylinder drum 1 towards the distributor plate 12 (to the right in FIG. 1). During the operation of the axial piston pump, respective orifices 18 of the cylinder bores 2 run over the distributor plate 12.

Figure 2:
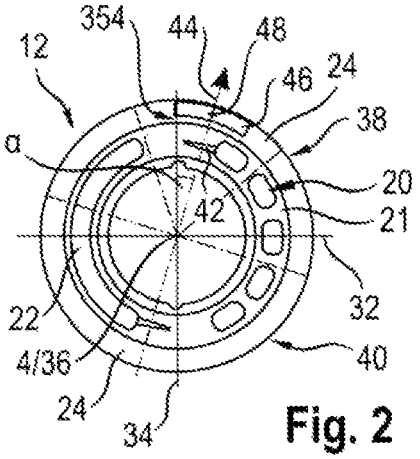
FIG. 2 shows a view of a distributor plate according to a first exemplary embodiment.

FIG. 2 shows a view of that side of the distributor plate 12 against which the cylinder drum 1 lies. Put more precisely, an outer edge region or an outer ring 24 is illustrated which is spaced apart somewhat (for example 1 mm) from the cylinder drum 1. Furthermore, the inner circular-ring-shaped axial projection which is divided into two circular-arc-shaped portions is illustrated. A high-pressure kidney-shaped aperture 20 which is divided into five through recesses is provided in the one circular-arc-shaped portion. A low-pressure kidney-shaped aperture 22 designed as a through recess is provided in the other circular-arc-shaped portion. A circular-arc-shaped hydrostatic main relief field 21 is provided in the direct vicinity around the high-pressure kidney-shaped aperture 20. Said main relief field is acted upon with high pressure and relieves the cylinder drum 1 in relation to the distributor plate 12. The two kidney-shaped apertures 20, 22 connect the orifices 18 (cf. FIG. 1) during their revolution about the longitudinal axis 4 in an alternating manner to the high-pressure side and the low-pressure side of the axial piston pump.

It is illustrated in FIG. 1 that each piston 6 during its displacement stroke is acted upon with a push-in force 26 and a transverse force 28 via the swashplate 10. The latter force is transmitted to the cylinder drum 1 via two axially spaced-apart supporting forces 30 in particular for each high-pressure-side piston 6. The oblique position of the swashplate 10 leads to an offset of the individual centers of gravity of the pistons relative to the pivoting plane. In conjunction with the rotational speed of the drive mechanism, this leads to an additional tilting moment on the cylinder drum. Said tilting moment is directed about the transverse axis 32 which is perpendicular to the plane of the drawing in FIG. 1.

FIG. 2 shows this transverse axis 32 with respect to the distributor plate 12 which intersects at a center point 36 with a center axis 34 of the distributor plate 12 and the longitudinal axis 4 of the axial piston pump. The two axes 32, 34 result in four respectively quarter-circle-shaped quadrants of the distributor plate 12. In this case, a first quadrant 38 coincides with that part of the high-pressure kidney-shaped aperture 20 over which the orifices 18 of the pistons 6 move in the first part of the displacement stroke thereof. A second quadrant 40 coincides with that part of the high-pressure kidney-shaped aperture 20 over which the orifices 18 of the pistons 6 move in the second part of the displacement stroke thereof. The first quadrant 38 is also defined by the fact that a fine control notch 42 is arranged therein, said fine control notch being intended to prevent an abrupt connection of the cylinder bores 2 to the high-pressure side via the high-pressure kidney-shaped aperture 20.

In the event of a summation of the tilting moment, which is explained with respect to FIG. 1, of all of the in particular high-pressure-side pistons 6, and by means of further moments and forces on the cylinder drum 1, a tilting direction 44 of the cylinder drum 1 arises that is directed from the center point 36 in the direction of the first quadrant 38. Put more precisely, in the case of the first exemplary embodiment according to FIG. 6, an angle $\alpha$ between the center axis 34 and the tilting direction 44 of 15° has been produced.

According to the first exemplary embodiment of the disclosure, a circular-arc-shaped relief surface 46 is formed on the outer ring 24 of the distributor plate 12 by a flat axial projection, said relief surface not being hydrostatically relieved. The relief surface 46 has a consistent width as viewed radially and extends over approximately 30° along the circumference of the distributor plate 12. The relief surface 46 is oriented in such a manner that its geometrical center point 48 lies on the tilting or supporting direction 44 or in the tilting or supporting direction 44. The tilting point of the cylinder drum 1 is therefore offset radially further outwards in the crucial tilting or supporting direction 44, and therefore lifting-off on one side is avoided and the oblique position of the cylinder drum 2 is reduced.

Figure 3:
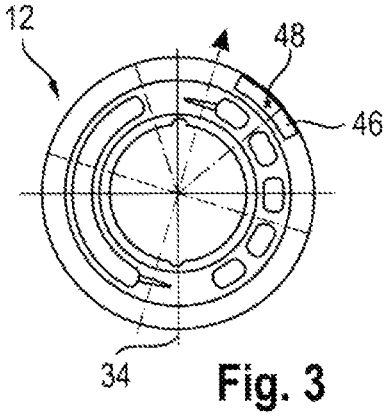
FIG. 3 shows a view of a distributor plate according to a second exemplary embodiment which is similar to the first exemplary embodiment.

FIG. 3 shows a second exemplary embodiment of the distributor plate 12 according to the disclosure, wherein the difference over the first exemplary embodiment according to FIG. 2 can be seen in the fact that the position of the center point 48 of the relief surface 46 is optimized for a tilting or supporting direction, the angle α of which is approximately 45° with respect to the center axis 34 of the distributor plate 12.

Figure 4:
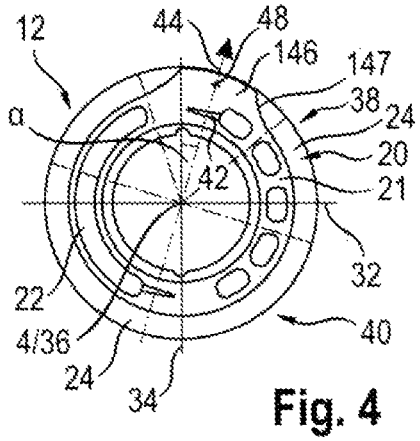
FIG. 4 shows a view of a distributor plate according to a third exemplary embodiment.

FIG. 4 shows a third exemplary embodiment of a distributor plate 12 of an axial piston pump according to the disclosure. Here—in a comparable manner to the first exemplary embodiment according to FIG. 2—the starting point is a tilting or supporting direction 44, the angle α of which is approximately 15° with respect to the center axis 34 of the distributor plate 12. The difference over the first exemplary embodiment according to FIG. 2 consists in that the relief surface is designed as a hydrostatic additional relief field 146 which is designed as a geometrical or flat extension of the hydrostatic main relief field 21. The hydrostatic additional relief field 146 therefore forms a radial extension of the main relief field 21 outwards as far as the outermost edge of the outer ring 24 of the distributor plate 12.

Figure 5:
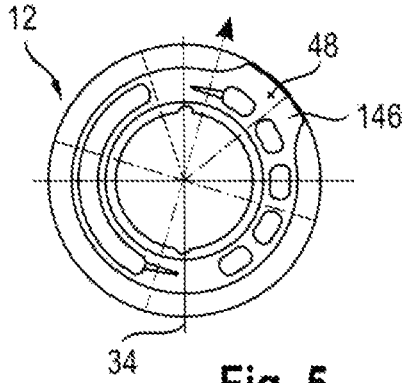
FIG. 5 shows a view of a distributor plate according to a fourth exemplary embodiment which is similar to the third exemplary embodiment.

FIG. 5 shows a fourth exemplary embodiment of a distributor plate 12 according to the disclosure, wherein the difference over the third exemplary embodiment according to FIG. 4 can be seen in that the position of the center point 48 of the hydrostatic additional relief field 146 is optimized for a tilting or supporting direction, the angle α of which is approximately 45° with respect to the center axis 34 of the distributor plate 12.

Figure 6:
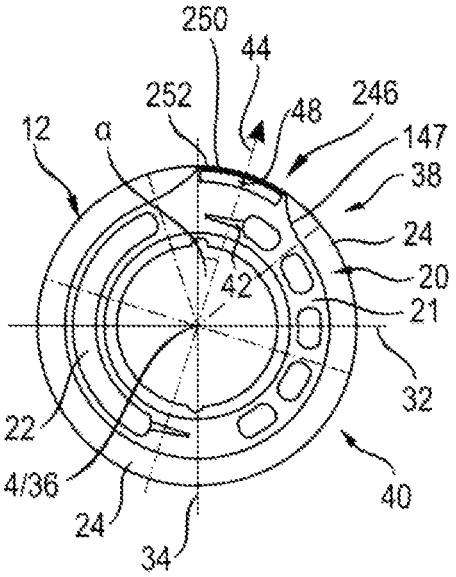
FIG. 6 shows a view of a distributor plate according to a fifth exemplary embodiment.

FIG. 6 shows a fifth exemplary embodiment of the distributor plate 12 according to the disclosure. In contrast to the third exemplary embodiment according to FIG. 4, the hydrostatic additional relief field 246 has a pocket 250 which extends from the contact plane 14 of the distributor plate 12 (cf. FIG. 1) radially in a direction away from the cylinder drum 1, as a result of which the depth of the pocket 250 is defined. The pocket 250 is surrounded and bounded on three sides by a sealing edge 252. On the radially inner side, the pocket 250 is bounded by the hydrostatic main relief field 21 arranged in the contact plane 14.

Figure 7:
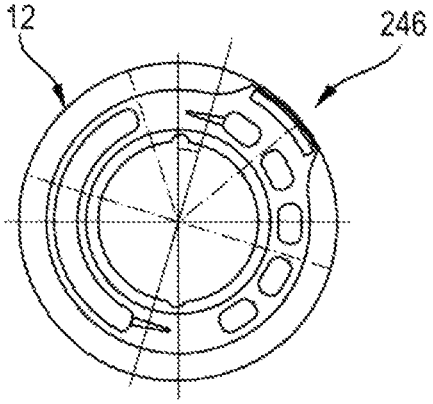
FIG. 7 shows a view of a distributor plate according to a sixth exemplary embodiment which is similar to the fifth exemplary embodiment.

Whereas, in the fifth exemplary embodiment according to FIG. 6, the center point 48 of the pocket 250 and therefore of the additional relief field 246 are arranged in such a manner that they are optimized for a tilting or supporting direction 44 which is positioned by approximately 15° with respect to the center axis 34, FIG. 7 illustrates a basically comparable further exemplary embodiment with additional relief fields 246 and pocket 250, in which the tilting or supporting direction 44 is approximately 30°.

Figure 8:
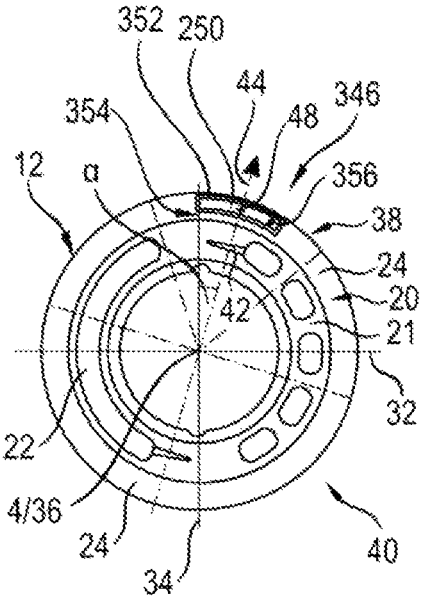
FIG. 8 shows a view of a distributor plate according to a seventh exemplary embodiment.

FIG. 8 shows a seventh exemplary embodiment of the distributor plate 12 according to the disclosure. In contrast to the fifth exemplary embodiment according to FIG. 6, the additional relief field 356 and the pocket 250 are decoupled here to a certain extent from the main relief field 21. Put more precisely, a depression 354 is provided between a radially inner part of the sealing edge 352 and the outer edge of the main relief surface 21. The area of said depression coincides with the surface of the outer ring 24 of the distributor plate 12 and is therefore at a distance (for example 1 mm) from the cylinder drum 1.

Figure 13:
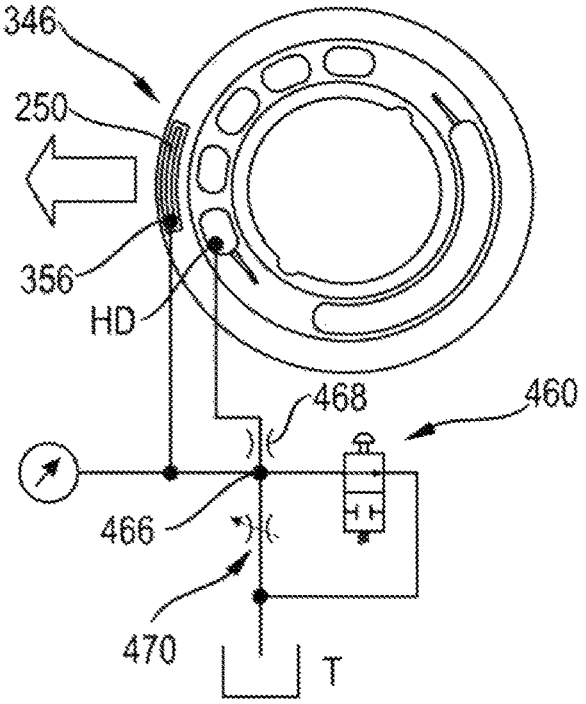
FIG. 13 shows a view of a distributor plate according to a tenth exemplary embodiment with a hydraulic device.
Figure 14:
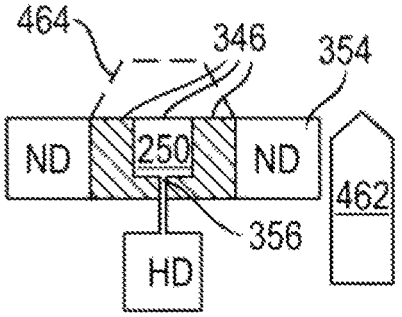
FIG. 14 shows a section through the additional relief field from FIG. 13 in a first operating state of the axial piston machine.
Figure 15:
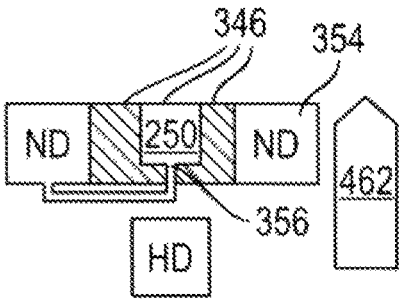
FIG. 15 shows a section through the additional relief field from FIG. 13 in a second operating state of the axial piston machine.

In order to activate the additional relief field 346, a connection is necessary to the high-pressure side of the machine, which connection is realized via an orifice 356 on the base of the pocket 250, and which is explained in more detail with respect to FIGS. 13 to 15.

Figure 9:
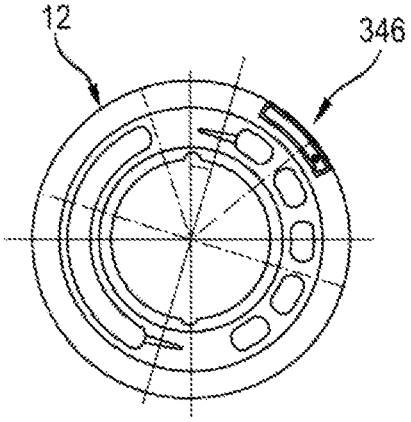
FIG. 9 shows a view of a distributor plate according to an eighth exemplary embodiment which is similar to the seventh exemplary embodiment.

Whereas, in the seventh exemplary embodiment according to FIG. 8, the center point 48 of the pocket 250 and therefore of the additional relief field 346 are arranged in such a manner that they are optimized for a tilting or supporting direction 44 which is positioned by approximately 15° with respect to the center axis 34, FIG. 9 illustrates a basically comparable further exemplary embodiment with additional relief fields 346 and pocket 250, in which the tilting or supporting direction 44 is approximately 30°.

Figure 10:
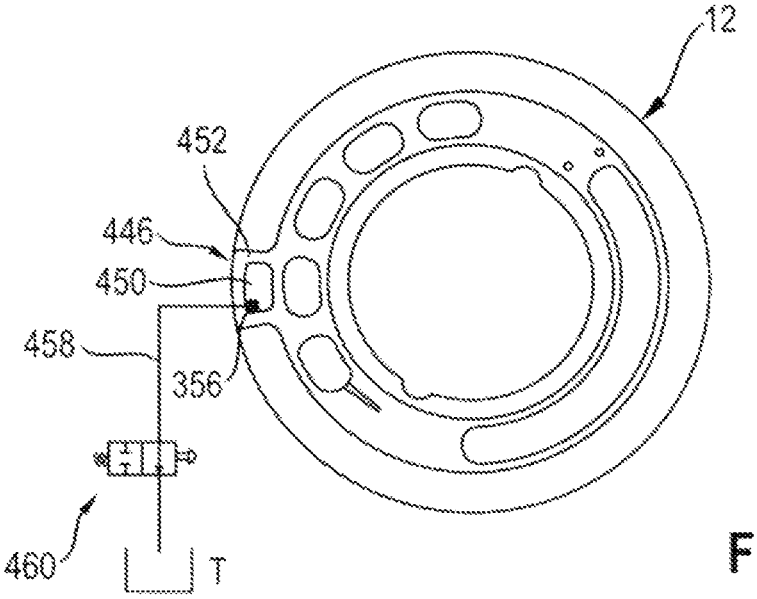
FIG. 10 shows a view of a distributor plate according to a ninth exemplary embodiment with a hydraulic device.

FIG. 10 shows a ninth exemplary embodiment of the distributor plate 12 according to the disclosure. The substantial difference over the distributor plate 12 of the sixth exemplary embodiment (from FIG. 7) can be seen here in that the additional relief field 446 attached to the main relief field is oriented at an enlarged angle α which is more than 45°.

The additional relief force of the hydrostatic additional relief field 446 can be controlled with a device. For this purpose, the device has a line 458 which can be formed by a channel, wherein the orifice 356 can be connected via a switching valve 460 to a pressure medium sink T. The switching valve 460 serves as a shut-off valve and, in a by a spring-pretensioned basic position, shuts off the orifice 356 and therefore the pocket 450 from the pressure medium sink T, and, in a switching position, connects the orifice 356 and therefore the pocket 450 to the pressure medium sink T. The pressure medium sink T can be a housing interior of the axial piston pump.

Figure 11:
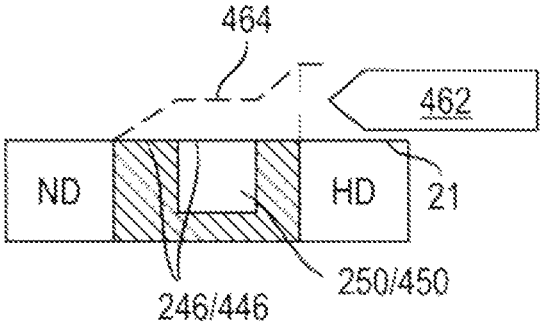
FIG. 11 shows a section through the additional relief field from FIG. 10 in a first operating state of the axial piston machine.

FIG. 11 shows, in a schematized sectional image, the hydrostatic additional relief field 246; 446 and the pocket 250; 450 of the fifth exemplary embodiment according to FIG. 6, of the sixth exemplary embodiment according to FIG. 7 and of the ninth exemplary embodiment according to FIG. 10. In the last-mentioned exemplary embodiment, the switching valve 460 is closed. Starting from the high-pressure kidney-shaped aperture of the main relief field 21, when supplied with a relief pressure medium, the relief pressure decreases according to the arrow 462 radially from the inside outwards as far as the outermost edge of the sealing edge. The (theoretical) profile 464 of the relief pressure that is shown in FIG. 11 arises here.

Figure 12:
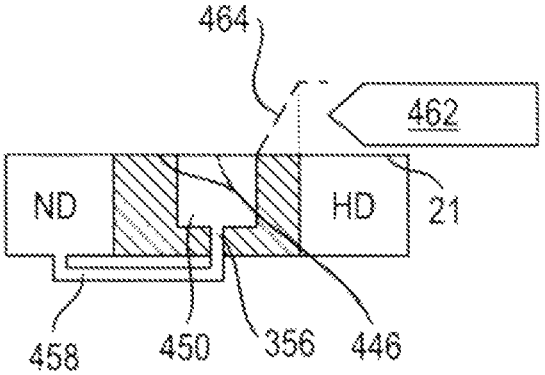
FIG. 12 shows a section through the additional relief field from FIG. 10 in a second operating state of the axial piston machine.

FIG. 12 shows, in a schematic cross section, the additional relief field 446 of the ninth exemplary embodiment according to FIG. 10, wherein the switching valve 460 is open. As a result, the pocket 450 is connected to the pressure medium sink and is therefore under low pressure ND. This results in a steeper and earlier decrease according to the profile of the relief pressure 464 as viewed radially from the inside outwards. The essential part of the additional relief field 464, which is defined in the ninth exemplary embodiment according to FIG. 10 by the pocket 450 and the radially outer portion of the sealing edge 452, is therefore deactivated and therefore without force.

FIG. 13 shows a distributor plate 12 according to a tenth exemplary embodiment. The essential difference over the distributor plate 12 of the eighth exemplary embodiment (from FIG. 9) can be seen here in that the additional relief field 346, which is offset from the main relief field, is oriented at an increased angle α which is more than 45°. Furthermore, the orifice 356 of the pocket 250 is connected to a location 466 of a pressure distributor circuit. A throttle 468 with a fixed cross section is arranged between the location 466 and a tapping of the high pressure HD, while a throttle 470 with an adjustable cross section is arranged between the location 466 and the pressure medium sink T. By adjustment of the throttle 470, the relief pressure in the pocket 250 can be adjusted.

Furthermore, the location 466 is also connectable to the pressure medium sink T via the switching valve 460 without throttling. The additional relief field 346 can therefore also be completely deactivated.

FIG. 14 shows, in a schematic cross section, the hydrostatic additional relief field 346 of the tenth exemplary embodiment according to FIG. 13. The state shown arises if the opening cross section of the adjustable throttle 470 is minimal and if the switching valve 460 is closed. This results in an approximately unreduced transmission of the high pressure HD into the pocket 250. Since housing pressure prevails in each case outside the encircling sealing edge, the high pressure dissipates radially inwards and radially outwards via the respective sealing edge in accordance with the shown profile 464 of the relief pressure.

FIG. 15 shows a schematic cross section through the hydrostatic additional relief field 346 when the pocket 250 thereof is connected to the low pressure ND of the pressure medium sink T. This state arises if the adjustable throttle 470 has a maximum opening cross section and/or if the switching valve 466 is open. The additional relief field 346 is therefore deactivated.

By means of the switching-over of the relief force of the hydrostatic additional relief field 346; 446, explained with respect to FIGS. 10 to 15, an overall relief force of a joint hydrostatic relief field is adapted, for example, during an operating mode change of the axial piston pump according to the disclosure into the motor mode. Put more precisely, when the switching valve 460 is closed, that state of the additional relief field 346; 446 that is illustrated schematically in FIGS. 11 and 14 and which corresponds to a pump mode is provided, while, by opening of the respective switching valve 460, that state of the hydrostatic additional relief field 346; 446 that is illustrated schematically in FIGS. 12 and 15 and is selected in a motor mode is provided.

Figure 16:
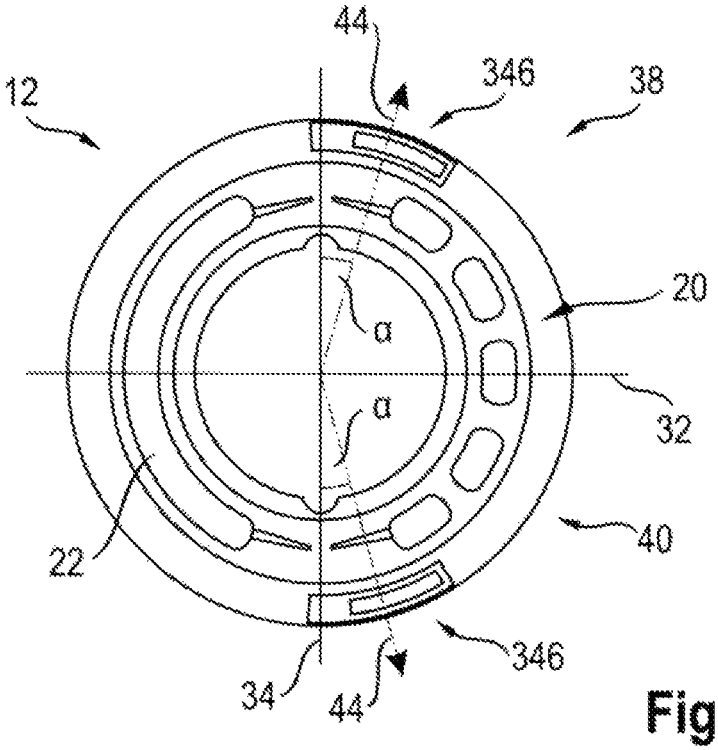
FIG. 16 shows a view of a distributor plate according to an eleventh exemplary embodiment.

FIG. 16 shows a distributor plate 12 according to an eleventh exemplary embodiment. It is substantially mirror-symmetrical to the transverse axis 32. It has an additional relief field 346 comparable to that of the seventh exemplary embodiment according to FIG. 8, wherein the first tilting or supporting direction 44—as explained with respect to FIG. 8—is positioned at the angle $\alpha$ of 15° with respect to the center axis 34. By means of the mirror symmetry with respect to the transverse axis 32, a hydrostatic additional relief field 346 is also provided in the second quadrant 40. A two-quadrant mode of the axial piston machine according to the disclosure is therefore possible, wherein a pressure side change is not provided.

Figure 17:
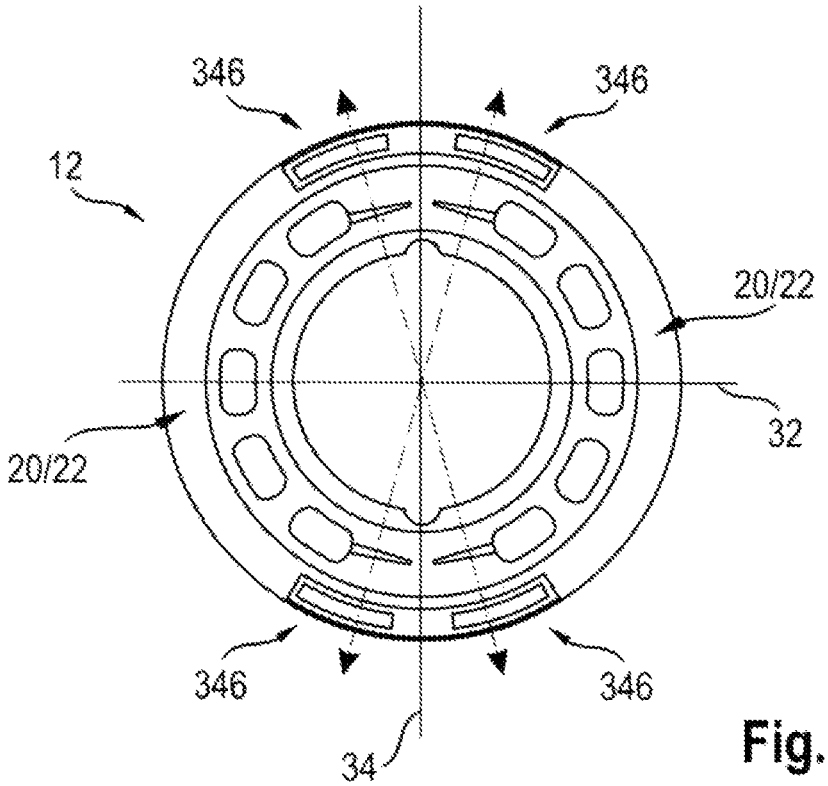
FIG. 17 shows a view of a distributor plate according to a twelfth exemplary embodiment.

FIG. 17 shows a distributor plate 12 according to a twelfth exemplary embodiment. The difference over the eleventh exemplary embodiment according to FIG. 16 can be seen in the fact that the distributor plate 12 is not only mirror-symmetrical with respect to the transverse axis 32, but also with respect to the center axis 34. The distributor plate 12 therefore has two kidney-shaped apertures which can each also be used as the high-pressure kidney-shaped aperture 20. With this distributor plate 12, a four-quadrant mode of the axial piston machine according to the disclosure is possible.

Figure 18:
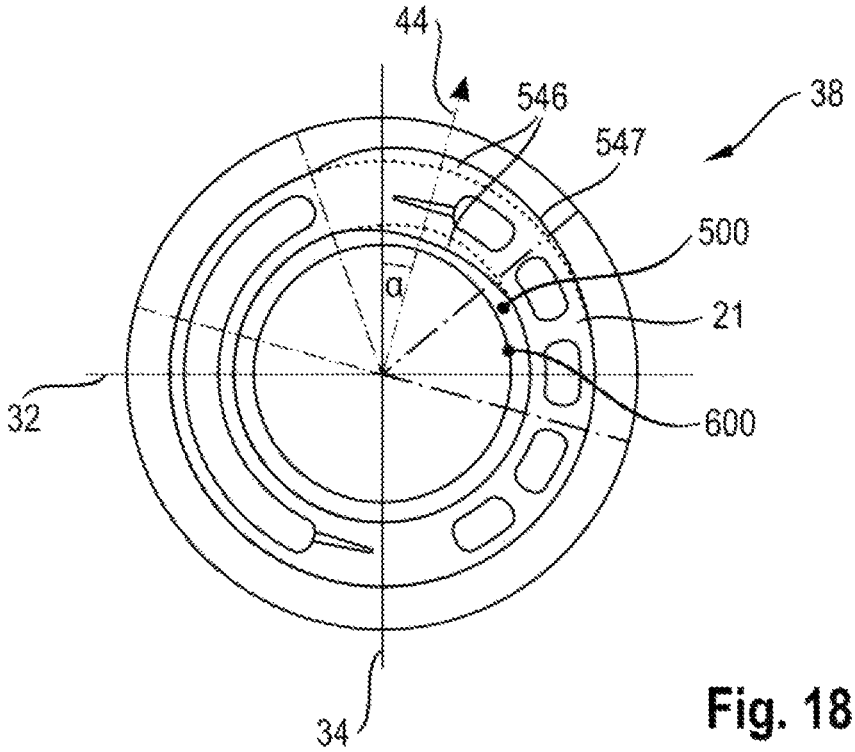
FIG. 18 shows a view of a distributor plate according to a thirteenth exemplary embodiment.

FIG. 18 shows a distributor plate 12 according to a further exemplary embodiment. In a manner basically approximately comparable to the third exemplary embodiment according to FIG. 4, a hydrostatic additional relief field 546 is provided in the first quadrant 38, said additional relief field being linked directly to the hydrostatic main relief field 21 and therefore being formed to a certain extent integrally therewith. In a departure from the third exemplary embodiment according to FIG. 4, the additional relief field 546 is divided into two parts, wherein a first part is positioned radially on the outside, and a second part radially on the inside, of the main relief field 21.

Figure 19:
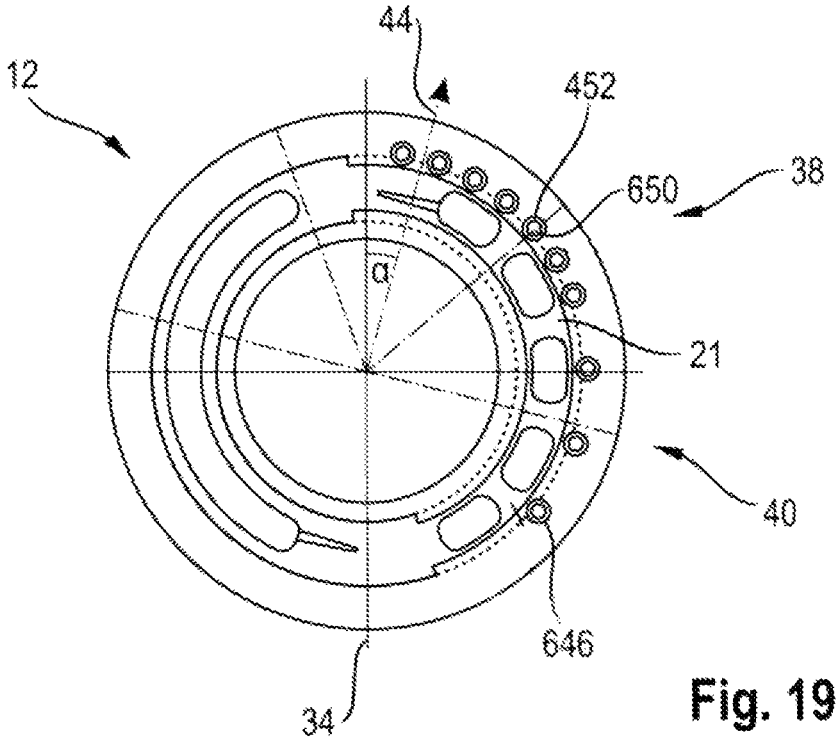
FIG. 19 shows a view of a distributor plate according to a fourteenth exemplary embodiment.

FIG. 19 shows a distributor plate 12 according to a fourteenth exemplary embodiment. The hydrostatic additional relief field 646 is divided into a plurality of smaller circular-ring-shaped parts which are arranged on a common radius on the outer circumference of the main relief field 21. The various parts of the additional relief field 646 are arranged partially in the first quadrant 38 and partially in the second quadrant 40. The distance of the individual parts of the additional relief field 646 from one another increases here—as seen from the first quadrant 38 in the direction of the second quadrant 40. Each of said small circular-ring-shaped parts is supplied with pressure medium via a bore from the rear side of the distributor plate 12 and hydrostatically relieved.

Plotted in FIG. 18 are two forces which are each directed perpendicularly to the plane of the drawing, apply to all of the exemplary embodiments shown and, for clarity reasons, are only illustrated in FIG. 18. An overall relief force 500 is directed here (out of the plane of the drawing) from the distributor plate 12 to the cylinder drum 1. Said overall relief force has been displaced, according to the disclosure, by the additional relief field or the additional relief fields 146; 246; 346; 446; 546; 646 in comparison to the prior art in such a manner that the distance thereof from the transverse axis 32 is increased. Furthermore, a contact pressure force 600 which arises from the difference of the larger circular cylinder bores 2 and the smaller orifices 18 on the cylinder drum 1 is illustrated. According to the disclosure, the distance between said two forces 500, 600 with respect to each other is increased, wherein said forces jointly produce a moment which is directed counter to the undesirable tilting moment of the cylinder drum 1.

A hydrostatic axial piston pump of swashplate construction, which can also be operated as a motor, is disclosed. It has a stationary control plate against which a rotating cylinder drum is tensioned. During operation, a tilting tendency of the cylinder drum arises in the direction of that quadrant of the control plate which is operatively connected to the first part of the displacement stroke of the pistons. Accordingly, the control plate has a supporting device for the cylinder drum, which supporting device is arranged adjacent to the outer edge of the control plate in the first quadrant thereof. The supporting device can be formed by a hydrostatically relieved additional field.

LIST OF REFERENCE SIGNS

1 Cylinder drum
2 Cylinder bore
4 Longitudinal axis
6 Piston
8 Sliding block
10 Swashplate
12 Distributor plate
14 Contact plane
16 Spring
**16*a*** Supporting disk
**16*b*** Pressure pins
**16*c*** Retraction ball
**16*d*** Retraction plate
18 Orifice (of the cylinder bore)

20 High-pressure kidney-shaped aperture
21 Hydrostatic main relief field
22 Low-pressure kidney-shaped aperture
24 Outer ring
26 Push-in force
28 Transverse force
30 Supporting force
32 Transverse axis
34 Center axis
36 Center point (of the distributor plate)
38 First quadrant
40 Second quadrant
42 Fine control notch
44 Tilting or supporting direction
46 Relief surface
48 Center point (of the relief surface)
146; 246; 346;
446; 546; 646 Hydrostatic additional relief field
147; 547 Portion of the outer edge
250; 450; 650 Pocket
252; 352; 452 Sealing edge
354 Depression
356 Orifice (of the pocket)
458 Line
460 Switching valve
462 Arrow
464 Profile of the relief pressure
466 Location
468 Throttle
470 Adjustable throttle
500 Overall relief force
600 Contact pressure force
α Angle between center axis and tilting or supporting direction
ND Low pressure
HD High pressure
T Pressure medium sink/housing interior

What is claimed is:

1. A hydrostatic axial piston machine, comprising: a circular distributor plate with a high-pressure kidney-shaped aperture and a low-pressure kidney-shaped aperture; and a cylinder drum tensioned against the distributor plate, wherein a diametrical transverse axis extends through a circumferential midpoint of the low-pressure kidney-shaped aperture and bisects the low-pressure kidney-shaped aperture, wherein a diametrical center axis extends perpendicular to the transverse axis, wherein the high-pressure kidney-shaped aperture is located entirely in a quarter-circle-shaped first quadrant and a quarter-circle-shaped second quadrant of the distributor plate, the first and second quadrants each defined by the transverse axis and the center axis, wherein a hydrostatic main relief field that extends into both quadrants is arranged on the distributor plate adjacent to the high-pressure kidney-shaped aperture, wherein the distributor plate has a relief surface on an outer circumference of the main relief field, the relief surface having a center point arranged in the first quadrant, and wherein the relief surface extends to a radial outside edge of the distributor plate, and wherein the relief surface is radially spaced apart from the main relief field.

2. The hydrostatic axial piston machine according to claim 1, wherein a supporting direction that is positioned at an angle of between 10 and 50 degrees with respect to the transverse axis is defined by the center point of the distributor plate and the center point of the relief surface.

3. The hydrostatic axial piston machine according to claim 1, wherein the main relief field defines a contact plane of the distributor plate, and wherein the cylinder drum lies against the contact plane and the relief surface is arranged in the contact plane.

4. The hydrostatic axial piston machine according to claim 1, wherein the complete relief surface is flat.

5. The hydrostatic axial piston machine according to claim 1, wherein the relief surface is defined by at least one hydrostatic additional relief field.

6. The hydrostatic axial piston machine according to claim 5, wherein the at least one additional relief field has a pocket or recess.

7. The hydrostatic axial piston machine according to claim 6, wherein the pocket or recess is connected via an orifice to a device via which an additional relief pressure is adjustable or controllable.

8. The hydrostatic axial piston machine according to claim 7, wherein the device has a switching valve via which the orifice is connectable to a pressure medium sink.

9. The hydrostatic axial piston machine according to claim 7, wherein the orifice is connected to a location that is arranged between a throttle and an adjustable throttle, the throttle and the adjustable throttle defining a pressure divider circuit.

10. The hydrostatic axial piston machine according to claim 1, wherein the relief surface is radially spaced apart from the main relief field by an outer ring of the distributor plate.

11. A hydrostatic axial piston machine, comprising: a circular distributor plate with a high-pressure kidney-shaped aperture and a low-pressure kidney-shaped aperture; and a cylinder drum tensioned against the distributor plate, wherein a diametrical transverse axis extends through a circumferential midpoint of the low-pressure kidney-shaped aperture and bisects the low-pressure kidney-shaped aperture, wherein a diametrical center axis extends perpendicular to the transverse axis, wherein the high-pressure kidney-shaped aperture is located entirely in a quarter-circle-shaped first quadrant and a quarter-circle-shaped second quadrant of the distributor plate, the first and second quadrants each defined by the transverse axis and the center axis, wherein a hydrostatic main relief field that extends into both quadrants is arranged on the distributor plate and surrounds the high-pressure kidney-shaped aperture, wherein the distributor plate has a relief surface on an outer circumference of the main relief field, the relief surface having a circumferential center point arranged in the first quadrant, wherein the relief surface extends continuously from a radial inner wall to a radial outside edge of the distributor plate and extends continuously from a first circumferential end wall to a second circumferential end wall, such that the relief surface is imperforate, and wherein the relief surface is radially spaced apart from the main relief field.

12. The hydrostatic axial piston machine according to claim 11, wherein the relief surface is radially spaced apart from the main relief field by an outer ring of the distributor plate.

* * * * *